US006212999B1

(12) United States Patent
Thompson

(10) Patent No.: US 6,212,999 B1
(45) Date of Patent: Apr. 10, 2001

(54) AUTOMATIC THROAT PACKING TORQUE CLIP

(75) Inventor: David J. Thompson, Oak Grove, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 09/219,299

(22) Filed: Dec. 21, 1998

Related U.S. Application Data

(60) Provisional application No. 60/070,367, filed on Jan. 2, 1998.

(51) Int. Cl.[7] ..... F16J 15/18; F04B 39/10

(52) U.S. Cl. ..... 92/168; 277/511; 417/554

(58) Field of Search ..... 92/168; 417/554; 277/511, 520, 526, 531, 532

(56) References Cited

U.S. PATENT DOCUMENTS

| | | | | |
|---|---|---|---|---|
| 2,231,680 | * | 2/1941 | Pfauser | 92/132 |
| 3,143,933 | * | 8/1964 | Norton | 92/168 X |
| 4,082,105 | * | 4/1978 | Allen | 277/500 X |
| 4,093,240 | * | 6/1978 | Masuda et al. | 92/168 X |
| 4,135,546 | * | 1/1979 | Morrison | 277/124 X |
| 4,169,605 | * | 10/1979 | Nishimoto et al. | 277/584 |
| 4,291,768 | * | 9/1981 | Diehl | 277/322 X |
| 4,328,973 | * | 5/1982 | Delbridge | 277/304 |
| 4,576,385 | * | 3/1986 | Ungchusri et al. | 277/562 |
| 4,659,064 | * | 4/1987 | Scobie et al. | 277/214 |
| 4,809,993 | * | 3/1989 | Henshaw | 277/529 |
| 4,936,197 | | 6/1990 | Brent . | |
| 4,989,882 | | 2/1991 | Warner et al. . | |
| 4,997,191 | | 3/1991 | Warner . | |
| 5,044,606 | | 9/1991 | Wordin . | |
| 5,267,533 | * | 12/1993 | Smith | 277/104 X |
| 5,346,037 | | 9/1994 | Flaig et al. | 92/168 X |
| 5,671,656 | * | 9/1997 | Cyphers et al. | 92/168 X |
| 5,740,718 | * | 4/1998 | Rathweg | 92/168 |

* cited by examiner

*Primary Examiner*—John E. Ryznic
(74) *Attorney, Agent, or Firm*—Douglas B. Farrow

(57) ABSTRACT

A reciprocating piston pump is provided with an automatic throat positive packing torque clip thereby providing consistent and extended pump life.

2 Claims, 3 Drawing Sheets

AUTOMATIC THROAT PACKING TORQUE CLIP

RELATED APPLICATIONS

This application is a continuation-in-part of U.S. application Ser. No. 60/070,367, filed Jan. 2, 1998.

BACKGROUND OF THE INVENTION

Reciprocating piston pumps for use in pumping paints and other viscous materials have been well known. Some of these pumps, are non-adjustable and thus when they start to leak must be repacked. Current adjustable designs are also susceptible to mis-assembly in variations in torque which lead to substantial variations in packing life.

SUMMARY OF THE INVENTION

It is therefore an object of this invention to provide a pump which is easily manufactured and further which may be consistently manufactured thereby leading to increased packing life.

In the instant invention, the torque clip is made from precision music wire which gives the design a tight wire diameter tolerance to be re-used indefinitely without requiring cylinder assembly externally which makes it easily accessible for removal once the pump begins leaking in the throat area.

With this design, the manufacturing consistency is improved greatly by taking the possibility of over-torqueing out of the equation. With the instant design, the operator installs the clip on the throat nut and then screws the throat nut into the cylinder housing until it sets on to the clip thereby resulting in no variance in packing squeeze which was formally induced by the throat nut. Testing has shown that packing squeeze can decrease the pump life by up to one half of its normal life if it is done improperly.

The same reasons that provide consistency in original manufacture also provided to the end user when the pump is repacked.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
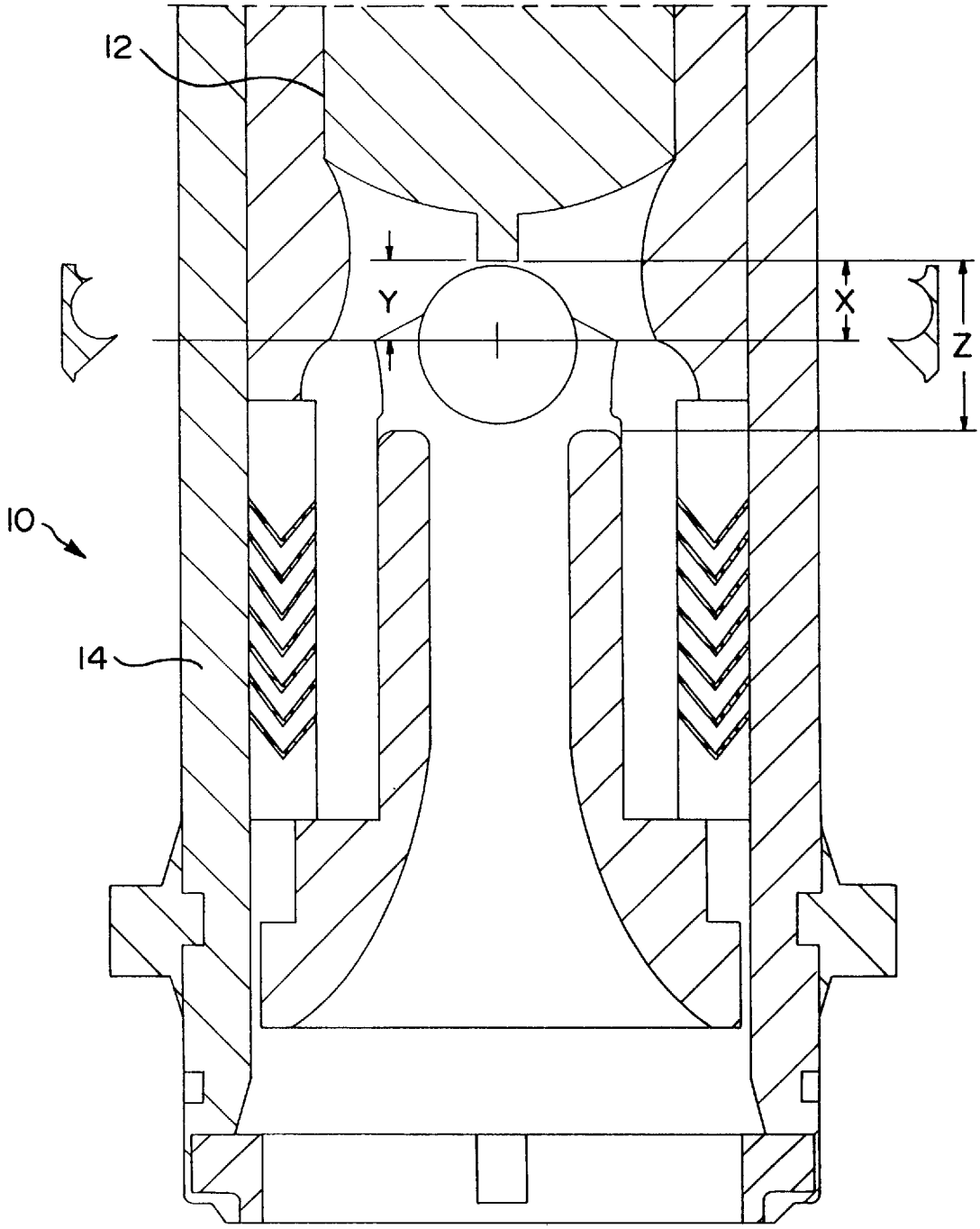
FIG. 1 is a cross-sectional view detailing the instant invention.
Figure 2:
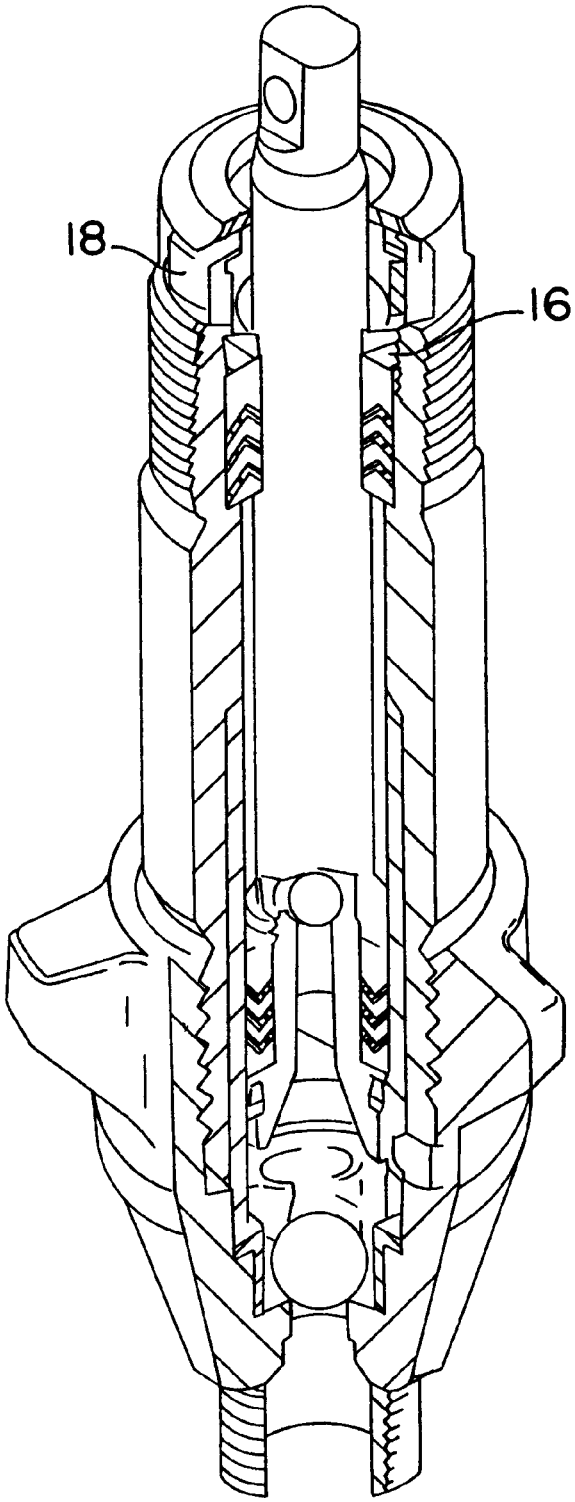
FIG. 2 is a cross-sectional view of the pump incorporating the instant invention.
Figure 3:
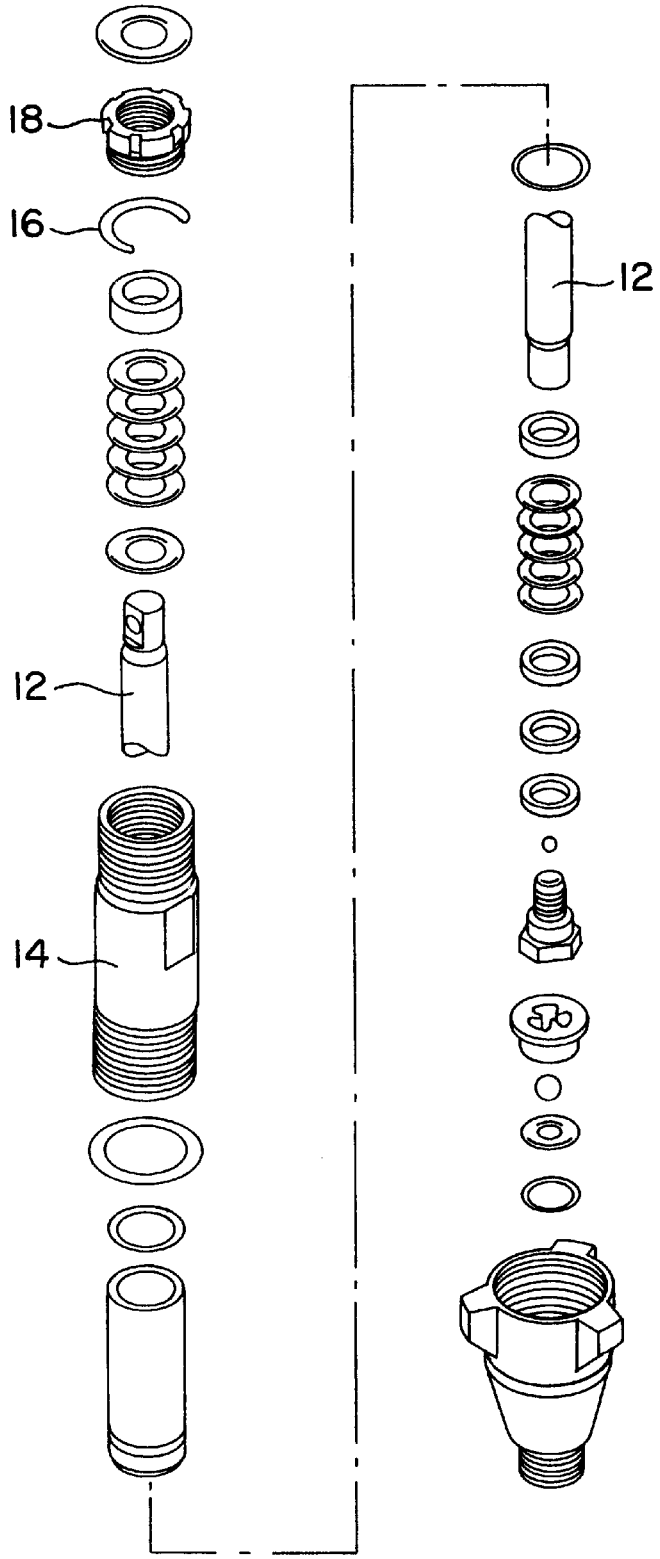
FIG. 3 is an exploded view of the pump incorporating the instant invention.

FIG. 1 shows the instant invention generally designated 10 and comprised of a pump rod 12 and cylinder 14, a retaining clip 16 and a throat nut 18. In the preferred embodiment, the clip 16 is made of music wire which has both very high tolerances (plus or minus 0.001 inches) and is a type of spring steel. In particular, depending on the size pump, the diameter of the wire may range from 0.095 to 0.138 inches.

It is contemplated that various changes and modifications may be made to the torque clip without departing from the spirit and scope of the invention as defined by the following claims.

What is claimed is:

1. In a reciprocating piston pump comprising a cylinder, a packing stack and a packing nut for compressing said packing stack in said cylinder, the improvement comprising a torque clip between said packing nut and said packing stack, said torque clip being made of a music wire material.

2. The reciprocating piston pump of claim 1 wherein said clip has a dimensional diameter tolerance of about 0.001 inches.

* * * * *